US009215919B2

(12) United States Patent
Apodaca et al.

(10) Patent No.: US 9,215,919 B2
(45) Date of Patent: Dec. 22, 2015

(54) COSMETIC DISPENSER WITH ROLLER APPLICATOR

(75) Inventors: Adrian C. Apodaca, Santa Monica, CA (US); Timothy Thorpe, Santa Monica, CA (US)

(73) Assignee: HCT ASIA LTD., Central (HK)

( * ) Notice: Subject to any disclaimer, the term of this patent is extended or adjusted under 35 U.S.C. 154(b) by 994 days.

(21) Appl. No.: 12/861,611

(22) Filed: Aug. 23, 2010

(65) Prior Publication Data

US 2012/0045270 A1 Feb. 23, 2012

(51) Int. Cl.
*A45D 34/04* (2006.01)
*A45D 40/26* (2006.01)

(52) U.S. Cl.
CPC ..... *A45D 34/041* (2013.01); *A45D 40/261* (2013.01); *A45D 2200/1009* (2013.01)

(58) Field of Classification Search
CPC ..... B05C 17/0215; B05C 17/0222; B05C 17/0225; B05C 17/035; B05C 17/0357; A45D 34/04; A45D 34/041
USPC ..... 401/208, 213, 219, 220, 183–186; D24/211
See application file for complete search history.

(56) References Cited

U.S. PATENT DOCUMENTS

| | | | | |
|---|---|---|---|---|
| D104,300 | S | | 4/1937 | Wolfsheim |
| D156,948 | S | | 1/1950 | Fisher |
| 2,518,382 | A | | 8/1950 | Ruthsatz |
| 2,816,308 | A | | 12/1957 | Schultz |
| 3,039,132 | A | | 11/1959 | Hambley |
| 3,028,868 | A | | 4/1962 | Tandler, Jr. |
| 3,095,598 | A | * | 7/1963 | Gonnella et al. ..... 401/220 |
| 3,235,900 | A | | 2/1966 | Klassen |
| 3,259,935 | A | | 7/1966 | Miller |
| 3,342,379 | A | | 9/1967 | Foley |
| D209,098 | S | | 10/1967 | Spiess |
| D230,137 | S | | 1/1974 | Bettonica |
| D239,160 | S | | 3/1976 | Giberstein |
| D245,398 | S | | 8/1977 | Grodin |
| 4,129,391 | A | * | 12/1978 | Gamacher ..... 401/208 |
| D268,097 | S | | 3/1983 | Thompson |
| D281,281 | S | | 11/1985 | Matalon |
| 4,648,732 | A | | 3/1987 | Smialkowski |
| D303,927 | S | | 10/1989 | Weber |
| 4,909,265 | A | * | 3/1990 | Goncalves ..... 401/208 |
| D317,407 | S | | 6/1991 | Gray et al. |

(Continued)

OTHER PUBLICATIONS

U.S. Appl. No. 29/352,089, filed Dec. 16, 2009, Timothy Thorpe, et al., "Cosmetic Dispenser".

(Continued)

*Primary Examiner* — David Walczak
*Assistant Examiner* — Bradley Oliver
(74) *Attorney, Agent, or Firm* — Seager, Tufte & Wickhem LLP

(57) ABSTRACT

A dispenser includes a deformable roller and a housing having a reservoir for containing a product, such as a cosmetic product or a medicinal product. The deformable roller comprises a napped roller over molded to, and encasing, a roller pin. Both the napped roller and the roller pin may be formed of materials that are suitable for an injection over-mold manufacturing process. The deformable roller disposed configured for applying product to a body and for deforming and tangentially mating and/or un-mating with an orifice of a reservoir of the housing for sealing and/or un-sealing the reservoir.

17 Claims, 7 Drawing Sheets

(56) References Cited

U.S. PATENT DOCUMENTS

| | | | | |
|---|---|---|---|---|
| D319,105 | S | 8/1991 | Cheng | |
| D324,994 | S | 3/1992 | Jentgen | |
| 5,116,156 | A * | 5/1992 | Landi | 401/208 |
| D337,207 | S | 7/1993 | Tiramani et al. | |
| 5,302,043 | A | 4/1994 | Velliquette | |
| D350,836 | S | 9/1994 | Chevassus | |
| D355,363 | S | 2/1995 | Iorii et al. | |
| D389,064 | S | 1/1998 | Sethi et al. | |
| D400,009 | S | 10/1998 | Conway | |
| 5,836,320 | A | 11/1998 | Gueret | |
| D405,684 | S | 2/1999 | Gager et al. | |
| D408,626 | S | 4/1999 | Lage | |
| D411,749 | S | 6/1999 | Nahum-Albright | |
| 5,934,816 | A | 8/1999 | Bruttomesso | |
| D416,491 | S | 11/1999 | Gobe | |
| D417,752 | S | 12/1999 | Bakic | |
| D418,253 | S | 12/1999 | Bakic | |
| D419,865 | S | 2/2000 | Gager et al. | |
| D422,139 | S | 4/2000 | Meikle | |
| D427,424 | S | 7/2000 | Conway | |
| D429,424 | S | 8/2000 | Vanderminden, Sr. | |
| D432,784 | S | 10/2000 | Conway | |
| 6,126,352 | A | 10/2000 | Wiley | |
| D436,434 | S | 1/2001 | Conway | |
| D447,694 | S | 9/2001 | Leggett | |
| 6,367,799 | B1 | 4/2002 | Sippel | |
| D468,423 | S | 1/2003 | Renfrew | |
| D470,415 | S | 2/2003 | Weber | |
| D483,418 | S | 12/2003 | Carr et al. | |
| D526,121 | S | 8/2006 | Nip | |
| D527,180 | S | 8/2006 | Raile | |
| D532,637 | S | 11/2006 | Bassett et al. | |
| D537,180 | S | 2/2007 | Hsu | |
| D553,355 | S | 10/2007 | Mosteller | |
| D572,476 | S | 7/2008 | Raile | |
| 7,461,993 | B1 * | 12/2008 | Sampaio | 401/271 |
| D594,320 | S | 6/2009 | Tanaka et al. | |
| 7,628,559 | B2 | 12/2009 | Petit | |
| D608,205 | S | 1/2010 | Bartholomeu et al. | |
| D620,808 | S | 8/2010 | Gieux | |
| D631,192 | S * | 1/2011 | Lim | D28/7 |
| D639,664 | S | 6/2011 | Thorpe et al. | |
| D643,294 | S | 8/2011 | Thorpe et al. | |
| 2004/0129284 | A1 | 7/2004 | Abergel | |
| 2007/0071538 | A1 * | 3/2007 | Doria | 401/219 |
| 2010/0028070 | A1 | 2/2010 | Gieux et al. | |
| 2011/0250008 | A1 * | 10/2011 | Lim | 401/188 R |

OTHER PUBLICATIONS

Beauty and Fashion Tech, "L'Oreal True Match Roller Foundation" retrieved on Jul. 21, 2010 at <<http://www.beautyandfashiontech.com/2010/01/loreal-true-match-roller-foundation.html>>, 8 pages.

* cited by examiner

COSMETIC DISPENSER WITH ROLLER APPLICATOR

BACKGROUND

Devices exist for dispensing cosmetic or medicinal products. Such devices usually consist of an outer tubular shell or housing, a delivery mechanism for displacement of the cosmetic or medicinal products, and an applicator tip. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body. However, existing applicators do not provide a roller applicator for sealing a reservoir. Accordingly, there remains a need in the art for improved applicators that provide a roller applicator that seals a reservoir.

SUMMARY

This summary is provided to introduce simplified concepts of dispensers with multi-layered applicator tips, which are further described below in the Detailed Description. This summary is not intended to identify essential features of the claimed subject matter, nor is it intended for use in determining the scope of the claimed subject matter.

This disclosure is directed to dispensers with deformable rollers configured for deforming and tangentially mating and/or un-mating with an orifice for sealing and/or un-sealing a reservoir. The deformable roller comprises a roller formed of a first material encasing a roller pin formed of a second material harder than the first material. The deformable roller may allow a product to be applied locally or topically to a selected area of a surface.

In one implementation, the deformable roller is coupled to a housing having a flexible wall for dispensing product and may have a reservoir for product storage. In another implementation, the deformable roller is coupled to a housing having a reservoir with two flexible walls for dispensing product. Additionally, the deformable roller may be selectively deformed when a cap is removably disposed on the housing.

In some implementations, the deformable roller may be manufactured via an injection over-molding process. Other manufacturing techniques are contemplated, for example, separately molding the roller pin and the roller and subsequently assembling the roller pin and roller, thereby producing the deformable roller. The roller pin may comprise a plastic, a composite, a metal, or any other suitable material. Likewise the roller may comprise a rubber, a plastic, a fabric, a sponge, or any other suitable material.

In still further implementations, deformable roller may be rotatably coupled to a pair of sockets protruding perpendicular from opposite ends of a collar having an elongated convex cradle disposed between the pair of sockets. The collar may interconnect the reservoir contained in the housing via a product delivery duct for dispensing product to a parabolic orifice terminating in a face of the elongated convex cradle.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to dispensers with deformable rollers that are disposed on housings with a flexible wall. The deformable roller has a roller formed of a first material for applying a product to a body and a roller pin, encased by the roller, formed of a second material harder than the first material for axially supporting the roller. The deformable roller is able to deform and tangentially mate and/or un-mate with an orifice. In particular, the deformable roller may have a napped roller comprising various rubbers, plastics, fabrics, or sponges, and a roller pin comprising various plastics, ceramics, or composites. For example, the napped roller and roller pin may be formed of plastics and may be made using an injection over-molding process. Additionally, product may be dispensed from the dispenser through a product delivery duct disposed in a collar and interconnected with a parabolic orifice terminating in a face of an elongated convex cradle for application of the product to a user's skin. In some implementations, the dispensers include a cap removably disposed on a housing encapsulating the deformable roller, deforming the roller pin, and forcing the deformable roller to tangentially mate the napped roller with the parabolic orifice.

Illustrative Dispenser with Deformable Roller

Figure 1:
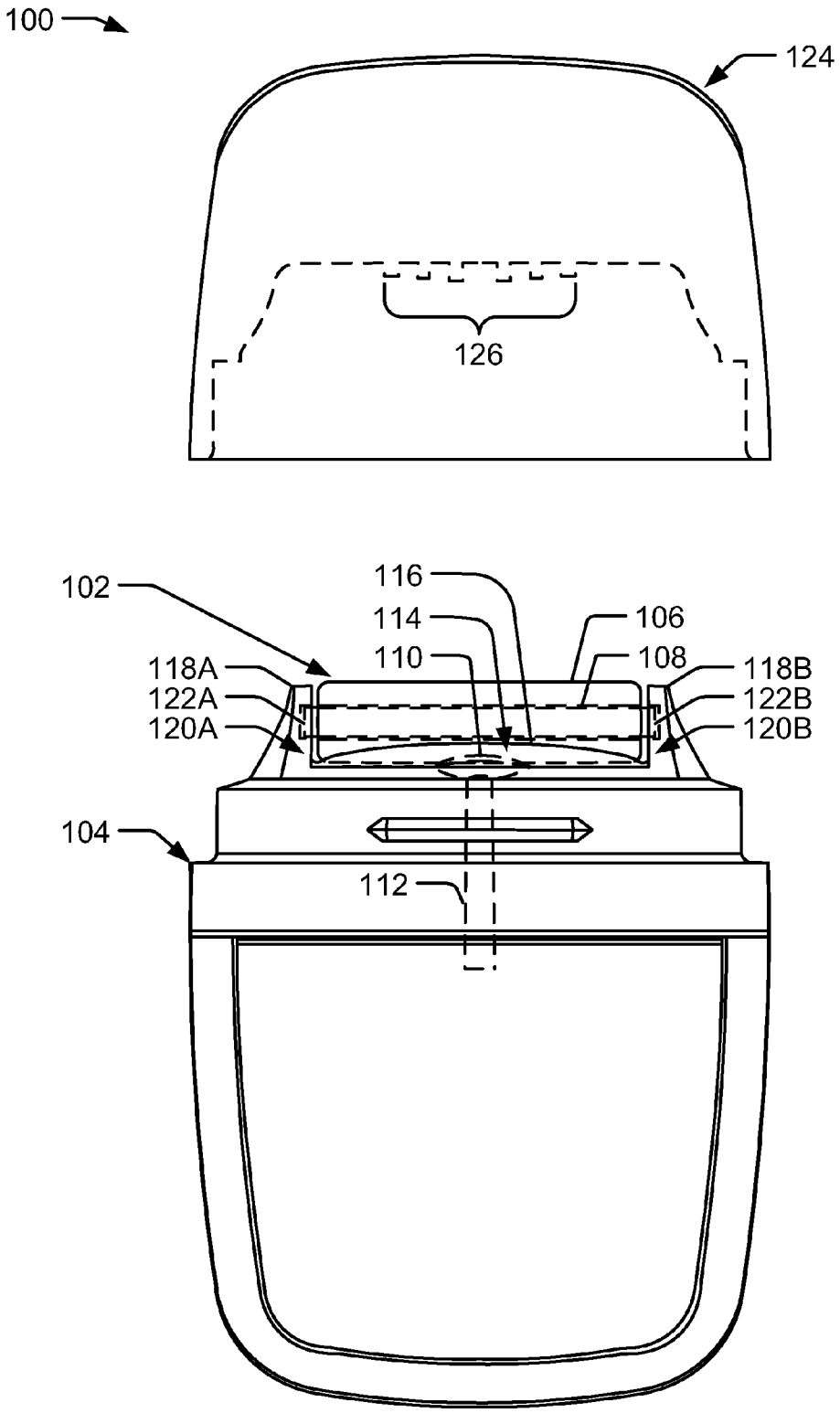
FIG. 1 represents an illustrative dispenser comprising a cap and a deformable roller coupled to a housing.

FIG. 1 represents an illustrative dispenser 100 with a deformable roller 102 and a housing 104. Deformable roller 102 comprises a napped roller 106 encasing a roller pin 108. In some embodiments, napped roller 106 may comprise rubber, nitrile-butadiene rubber (NBR), terpolymer or acrylonitrile butadiene styrene (ABS), or other materials suitable for applying a product to a body. In some embodiments, the roller pin 108 may comprise polypropylene (PP), low-density polyethylene (LDPE), or other materials suitable for axially supporting deformable roller 102. In the embodiment of FIG. 1, the deformable roller 102 is illustrated as being generally an elongated cylindrical shape unit comprising the napped roller 106 over molded to, and encasing, roller pin 108. FIG. 1 illustrates the deformable roller 102 being disposed tangentially to an orifice 110, and wherein the orifice 110 is illustrated as being disposed distal to the housing 104. Further, FIG. 1 illustrates orifice 110 being interconnected to a reservoir of housing 104 via a product delivery duct 112. In this embodiment, the orifice 110 is illustrated as terminating in a face 114 of an elongated convex cradle 116. Here, the deformable roller 102 is illustrated as being cradled by the elongated convex cradle 116.

FIG. 1 illustrates a first socket 118A protruding substantially perpendicular from a first end 120A of the elongated convex cradle 116 and a second socket 118B protruding substantially perpendicular from a second end 120B, opposite the first end 120A, of the elongated convex cradle 116. Further, FIG. 1 illustrates the deformable roller 102 rotatably coupled with the first socket 118A and second socket 118B of the elongated convex cradle 116. Specifically, the first socket 118A and the second socket 118B are illustrated in FIG. 1 as receiving a first end 122A and a second end 122B of the deformable roller 102, respectively.

In this example, the housing 104 is substantially pouch-shaped. The housing 104 may comprise a flexible wall or may comprise two flexible walls for forcing product to the face 114 for disposing product to the deformable roller 102. Housing 104 may be comprised of plastic, metal, ceramic or any other suitable material. For example, housing 104 may be comprised of terpolymer (e.g., DuPont™ Surlyn®), polypropylene (PP), acrylonitrile butadiene styrene (ABS) or Polyoxymethylene (POM).

The dispenser 100 may also include a cap 124 that encapsulates the deformable roller 102 when the dispenser is not in use. The cap 124 includes protrusions 126 that tangentially mate with the deformable roller 102 opposite to the orifice 110 for deforming (i.e., displacing) the deformable roller 102 and tangentially mating the deformable roller 102 with the orifice 110, when the dispenser is not in use. The protrusions 126 may be made of a thermoplastic polymer or any other material which is suitable for deforming the deformable roller 102, such as various metals, plastics, ceramics, composites, or the like.

Figure 2:
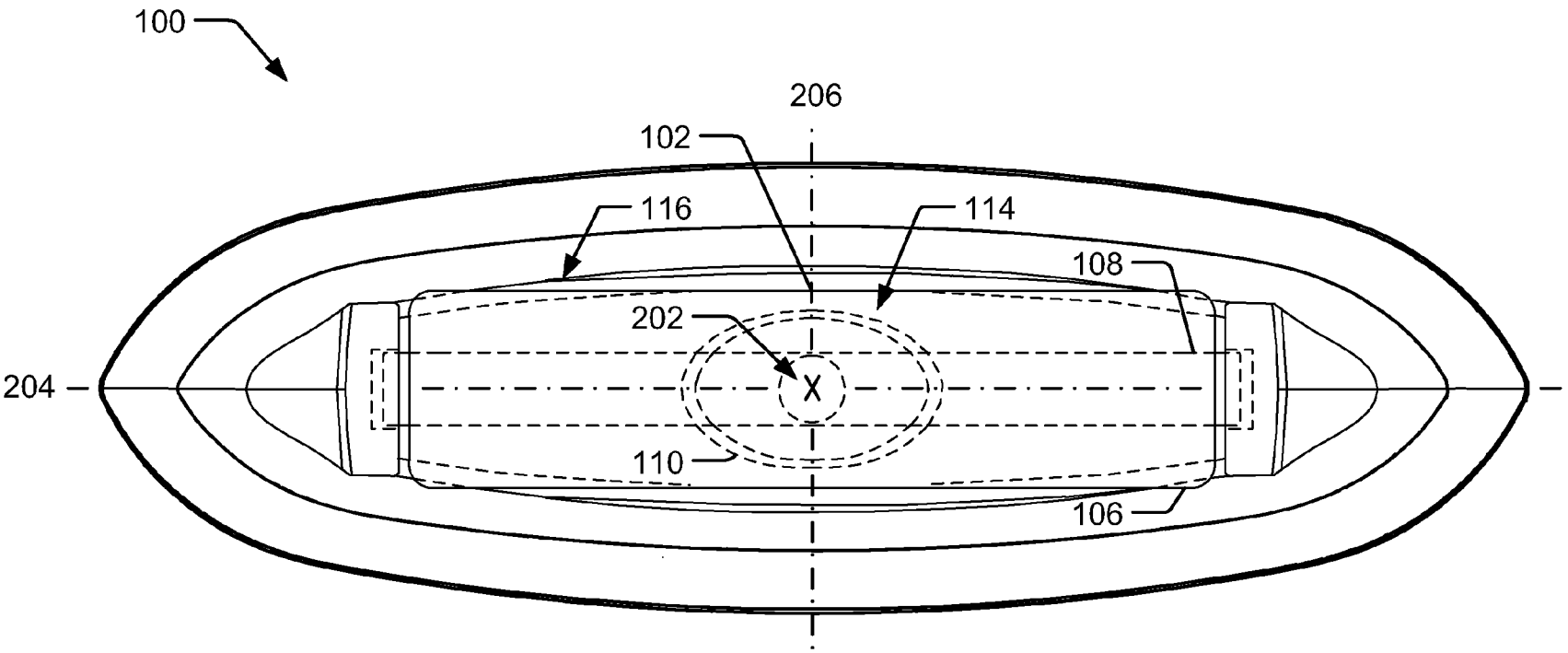
FIG. 2 illustrates a top view of the deformable roller of the dispenser shown in FIG. 1 in more detail.

FIG. 2 is a top view of the deformable roller 102 of the dispenser 100 in more detail. Again, the deformable roller 102 generally comprises a napped roller 106 encasing a roller pin 108. The deformable roller 102 is illustrated as being arranged along the elongated convex cradle 116 and tangentially to the orifice 110. FIG. 2 illustrates the orifice 110 as terminating substantially proximate to a center 202 of face 114, and the center 202 is illustrated as being disposed substantially proximate to the middle of a longitudinal axis 204 and the middle of a latitudinal axis 206. Specifically, FIG. 2 illustrates orifice 110 being a parabolic-shaped orifice terminating substantially proximate to the center 202 of face 114; however, other shapes, such as circular or the like would suffice. Further, FIG. 2 illustrates deformable roller 102 as being generally an elongated cylindrically shaped roller configured to tangentially mate with orifice 110 when the dispenser is not in use. Specifically, the napped roller 106 encasing the roller pin 108 is configured to tangentially mate with the orifice 110 when the deformable roller 102 is deformed, sealing the reservoir of housing 104.

Figure 3A:
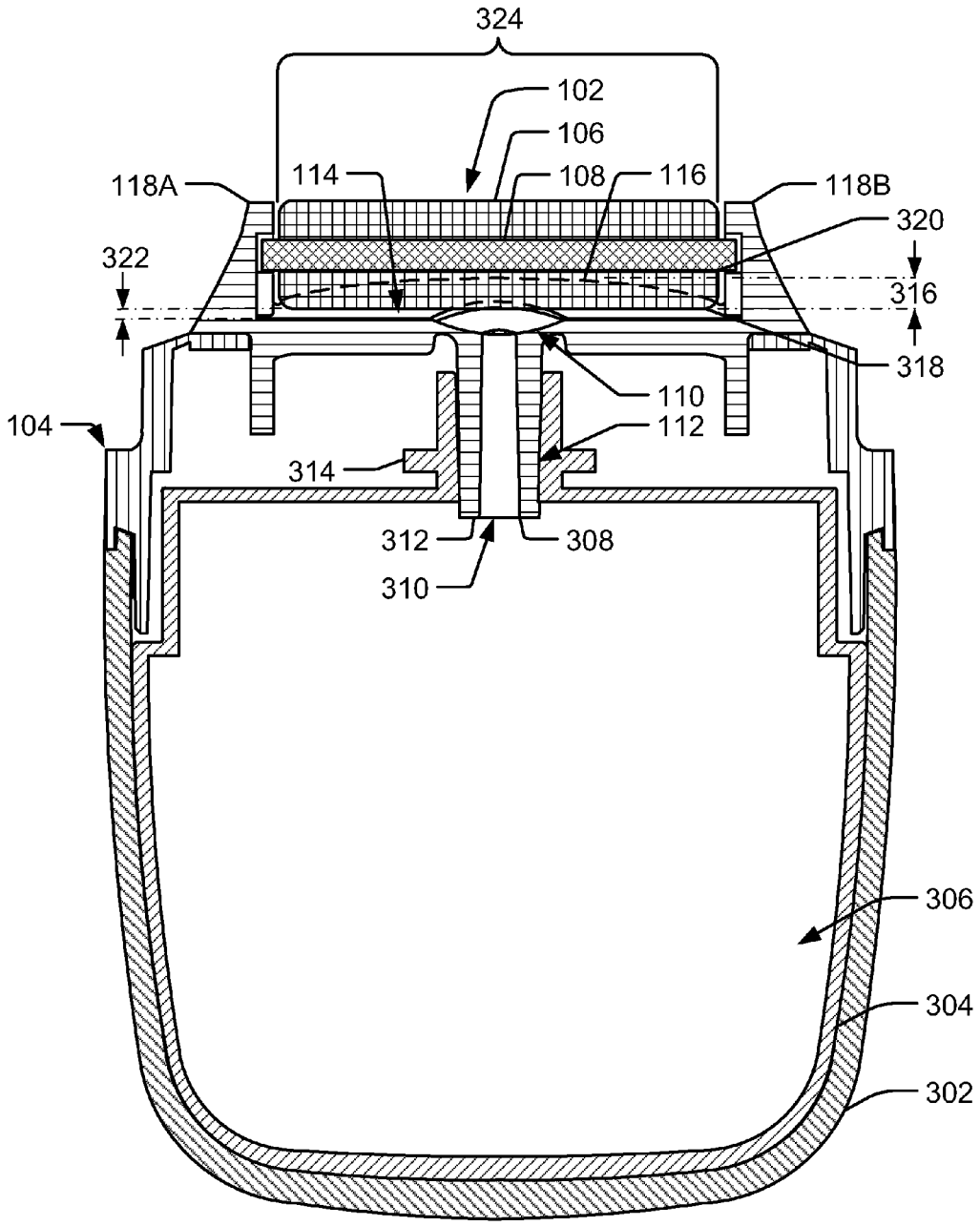
FIG. 3A illustrates a cross-section of the deformable roller of the dispenser shown in FIG. 1, taken along longitudinal axis 204 of FIG. 2.
Figure 3B:
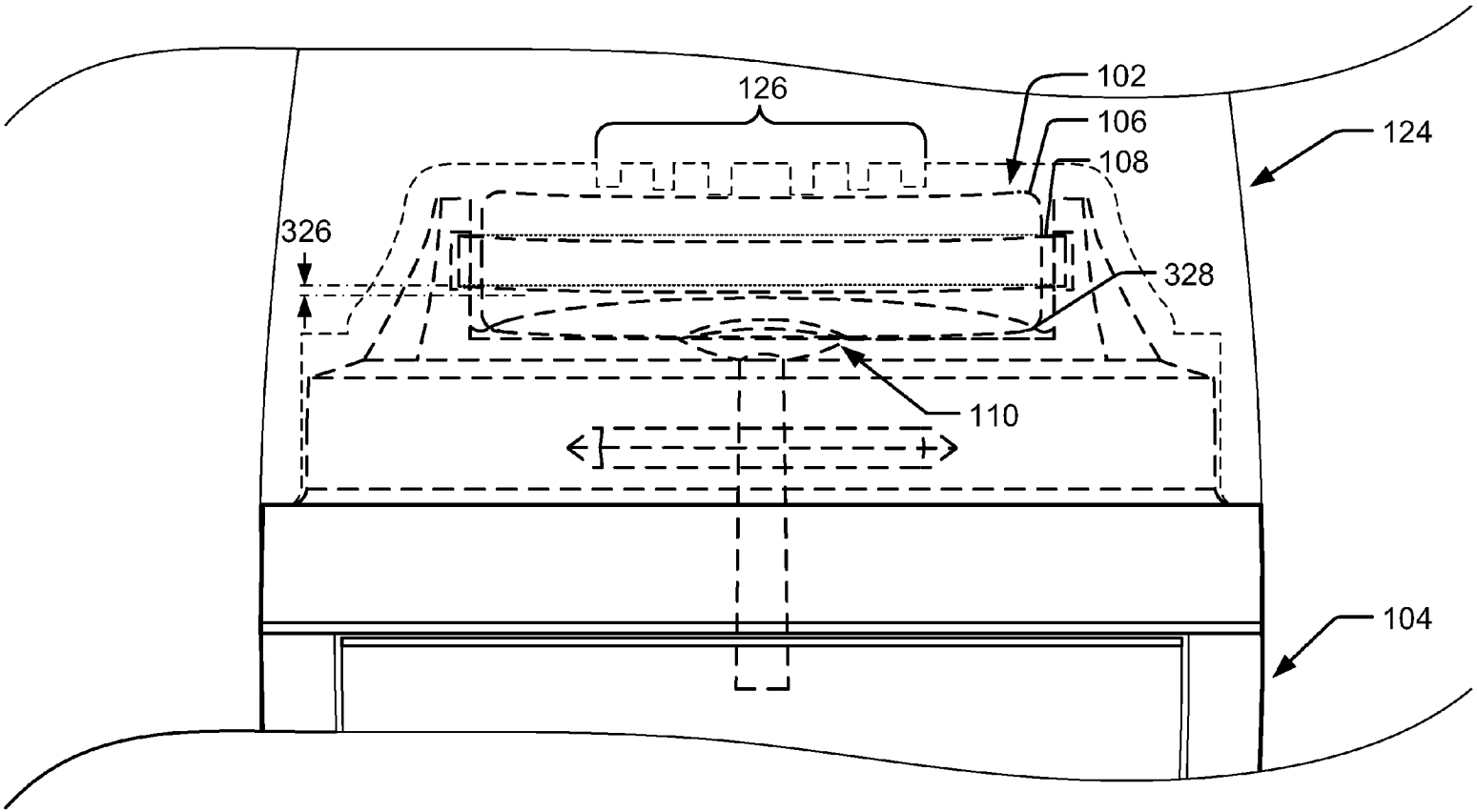
FIG. 3B illustrates a close-up detail of the dispenser illustrated in FIG. 1 when the dispenser is not in use.

FIG. 3A illustrates a cross-section of dispenser 100 taken along the longitudinal axis 204 illustrated in FIG. 2 and illustrates details of the interconnection of the housing 104 and the deformable roller 102 of the dispenser 100 shown in FIG. 1. FIG. 3B illustrates a close-up detail of the dispenser illustrated in FIG. 1 when the dispenser is not in use.

In the illustrated implementation of FIG. 3A, the housing 104 comprises a shelled wall 302 configured to surround and hold a reservoir 304. In some embodiments, the reservoir 304 may comprise a substantially clear or translucent terpolymer. While FIG. 3A illustrates housing 104 surrounding and holding reservoir 304, in other embodiments the housing 104 itself my act as a reservoir. In that case, housing 104 may be formed of a flexible and translucent terpolymer. Here however, the shelled housing 104 provides exposure to a portion of the reservoir 304, the exposed portion of the reservoir 304 defining a flexible wall 306. The flexible wall 306 is configured to displace a portion of a product stored in the reservoir 304 into the product delivery duct 112 and out of the orifice 110, which terminates in the face 114 of the elongated convex cradle 116.

As illustrated in FIG. 3A, reservoir 304 may be interconnected to face 114 via the product delivery duct 112, and the product delivery duct 112 may comprise the orifice 110, the orifice 308 and the bore 310. The bore 310 may extend vertically through a connector stem 312 disposed distal to the orifice 110. Here, the connector stem 312 is received by a reservoir coupling mechanism 314. With the connector stem 312 securely coupled to the reservoir coupling mechanism 314, the product delivery duct 112 is able to transport product from the reservoir 304 through the product delivery duct 112 to the face 114, when the exposed flexible wall 306 of the reservoir 304 is displaced. However, as discussed above, the housing 104 may itself be a clear and flexible reservoir formed of, for example, terpolymer, capable of being displaced and thereby dispensing product through the product delivery duct 112 to the face 114.

Having described the dispenser 100 being configured to deliver product from the reservoir 304 to the face 114, the following describes the deformable roller 102 being configured for deforming and tangentially mating and/or un-mating with the orifice 110 for sealing and/or un-sealing the reservoir 304. Here, for illustrative purposes, the napped roller 106 is illustrated as showing the hidden line behind the napped roller 106 of the convex cradle 116.

FIG. 3A also illustrates, the deformable roller 102 arranged along the elongated convex cradle 116 tangentially to the orifice 110. Additionally, the deformable roller 102 may be rotatably coupled with the first socket 118A and the second socket 118B of the elongated convex cradle 116. Further, an overlap distance 316 of the napped roller 106 may be cradled in the elongated convex cradle 116 for applying product to the deformable roller 102 when product is present in the face 114. Specifically, FIG. 3A illustrates the overlap distance 316 of the napped roller 106 cradled in the elongated convex cradle 116 as being about 1.5 millimeters from a bottom edge 318 of the napped roller 106 proximate to about a bottom edge 320 of the roller pin 108. FIG. 3A also illustrates a separation distance 322 from the orifice 110 terminating in the face 114 to the bottom edge 318 of the napped roller 106. In one implementation, the separation distance 322 may be about 0.5 millimeters. With the overlap distance 316 and the separation distance 322, the dispenser 100 may be configured to squeeze product to the face 114 of the elongated convex cradle 116, where the product is dispersed about the face 114 for depositing onto deformable the roller 102 for subsequently applying to a body when the dispenser 100 is in use. While FIG. 3A illustrates an overlap distance 316 of the napped roller 106 as being about 1.5 millimeters, other overlap distances 316 are contemplated. For example, the overlap distance 316 may be less than about 1.5 millimeters or more than about 1.5 millimeters, suitable for applying product to the deformable roller 102. Further, while FIG. 3A illustrates a separation distance 322 from the orifice 110 to the bottom edge 318 of the napped roller 106 as being about 0.5 millimeters, other separation distances 322 are contemplated. For example, the separation distance 322 may be less than about 0.5 millimeters or more than about 0.5 millimeters, suitable for applying product to the deformable roller 102.

FIG. 3B illustrates a close-up detail of the dispenser 100 when it is not in use. Here, the cap 124 of FIG. 1 is illustrated as removably disposed on the housing 104, and the protrusions 126 of the cap 124 tangentially mate with the napped roller 106 opposite to the orifice 110. When the protrusions 126 tangentially mate with the napped roller 106, the deformable roller 102 is deformed (i.e., displaced) from a relaxed position 324 of FIG. 3A (i.e., the deformable roller 102 is substantially straight). Specifically, with the roller pin 108 being formed of the second material harder than the first material forming the napped roller 106, the roller pin 108 is configured to deform (i.e., displace) at least about the separation distance 322 of FIG. 3A. Here, in FIG. 3B, the roller pin 108 is illustrated as being displaced from the relaxed position 324 a distance 326, which is equivalent to the separation distance 322. With the roller pin 108 deformed the distance 326, an edge 328 of napped roller 106 is illustrated as being tangentially mated against the orifice 110. With the deformable roller 102 tangentially mated with the orifice 110, the deformable roller 102 thereby seals the reservoir 304.

When the cap 124 is removed from the housing 104, the protrusions 126 of cap 124 no longer tangentially mate with the napped roller 106. With the protrusions 126 of cap 124 no longer tangentially mated with the napped roller 106, the roller pin 108 being formed of the second material harder than the first material forming the napped roller 106 may be configured to be displaced back, at least about the separation distance 322, into the relaxed position 324, as discussed above with respect to FIG. 3A. With the roller pin 108 configured to displace the separation distance 316 back into the relaxed position 324 when the cap 124 is removed from the housing 104, the deformable roller 102 may be configured to un-mate with the orifice 110 for un-sealing the reservoir 304. While FIG. 3A illustrates a single orifice 110 that is parabolic-shaped, multiple orifices are contemplated. For example, two, three, four, or any number of orifices may be arranged in the face 114 of the elongated convex cradle 116 suitable for dispensing product to the face 114.

Alternative Illustrative Dispensers

Figure 4:
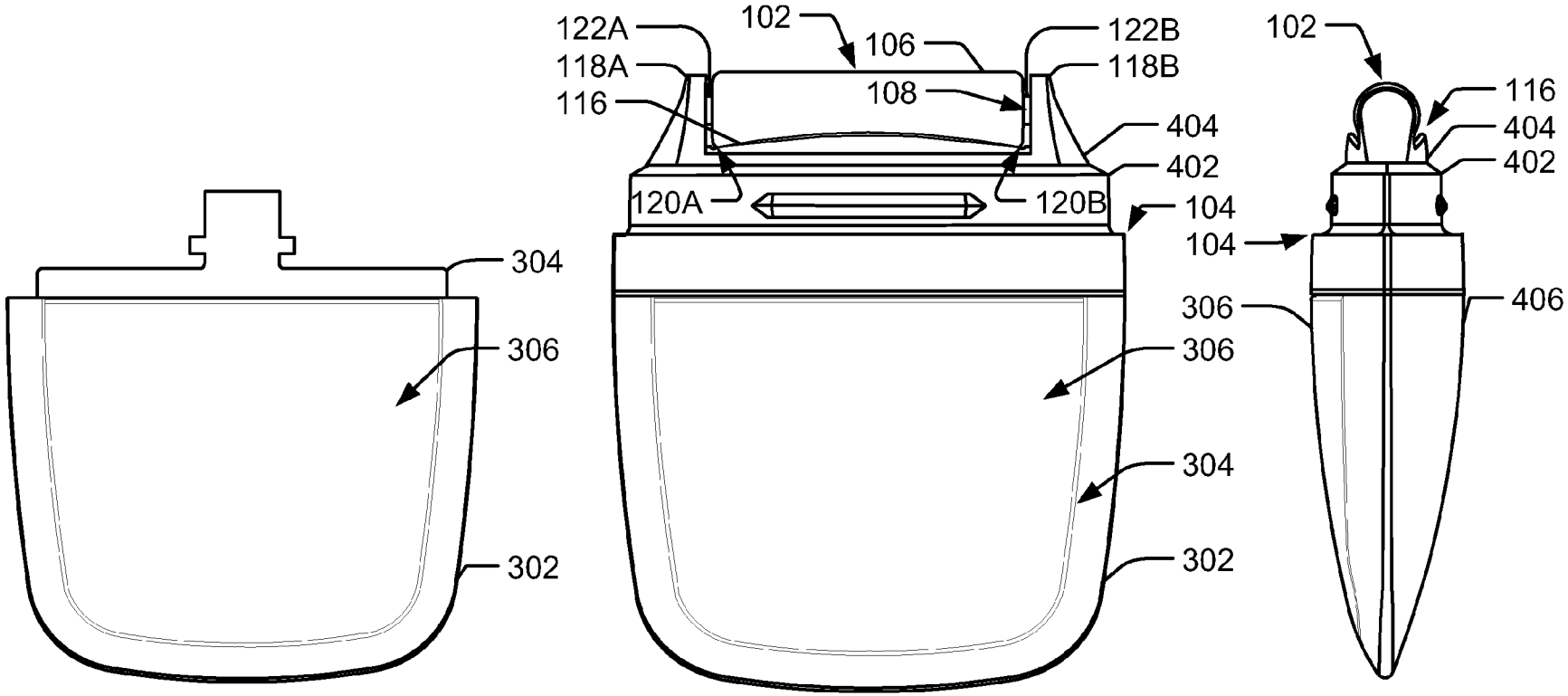
FIG. 4 illustrates a dispenser comprising a housing with a flexible wall and a deformable roller disposed thereon according to one illustrative implementation.
Figure 5:
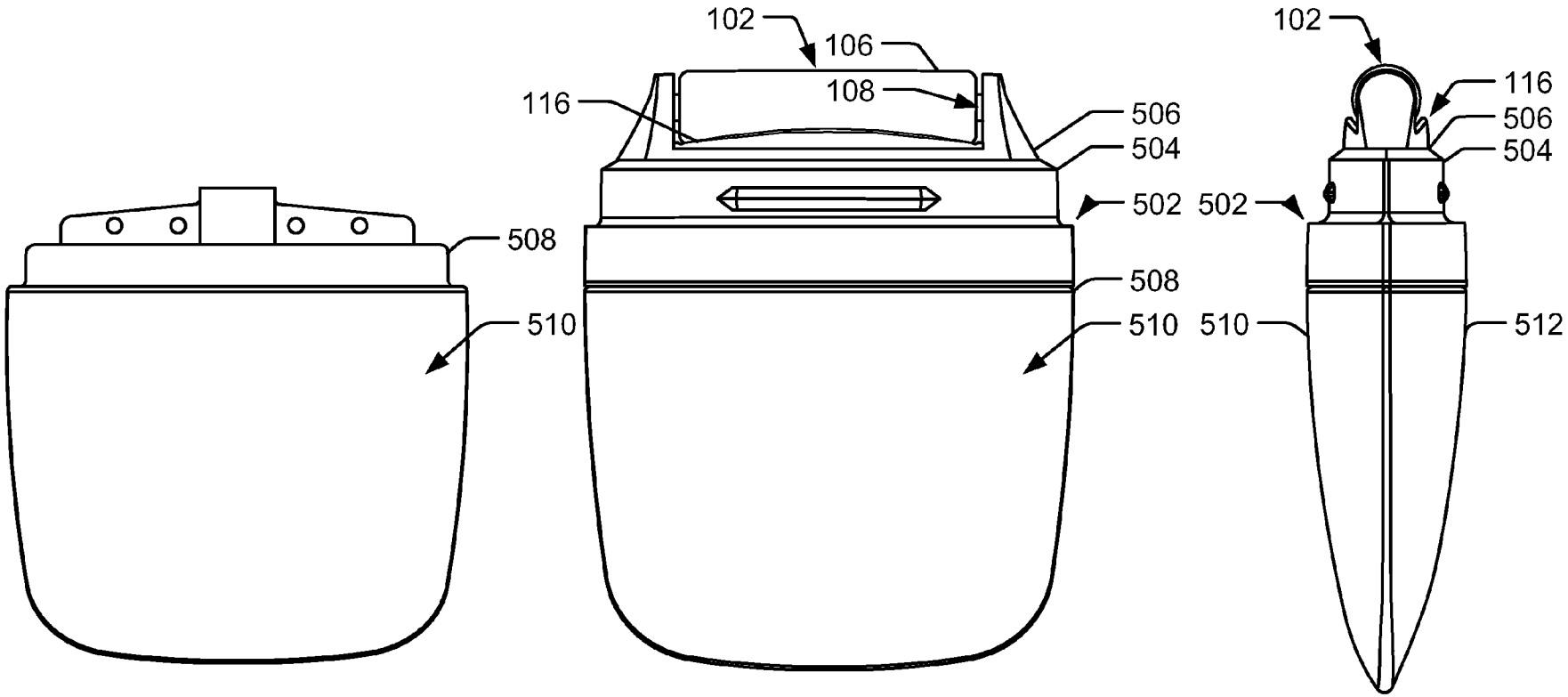
FIG. 5 illustrates a dispenser comprising a housing with two flexible walls according to another illustrative implementation, the housing having a similar deformable roller disposed thereon as the deformable roller illustrated in FIG. 4.

FIG. 4 and FIG.5 illustrate alternative deformable roller dispensers. A front view of each embodiment is illustrated generally in the center portion of each of FIG. 4 and FIG. 5. A respective side view of each embodiment is illustrated generally on the right portion of FIG. 4 and FIG. 5. Also illustrated generally on the left portion of FIG. 4 and FIG. 5 are respective housings.

Specifically, FIG. 4, illustrates a deformable roller 102 similar to that discussed above (e.g., the deformable roller 102 may comprise a napped roller 106 molded about a roller pin 108) coupled to a housing 104. Here, a collar 402 is illustrated to be disposed on top of the housing 104 and about a portion of a roller collar 404 fixed distal to the housing 104. Collar 402 may support a roller collar 404 to a reservoir 304. FIG. 4 also illustrates the roller collar 404 comprising the elongated convex cradle 116 having a first socket 118A protruding substantially perpendicular from a first end 120A of the elongated convex cradle 116 and a second socket 118B protruding substantially perpendicular from a second end 120B, opposite the first end 120A, of the elongated convex cradle 116. Here, as discussed above with respect to FIG. 1, the first socket 118A and the second socket 118B are illustrated in FIG. 4 as receiving a first end 122A and a second end 122B of the deformable roller 102, respectively. As discussed above, housing 104 comprises a shelled wall 302, the shelled wall 302 exposing a flexible wall 306 of the reservoir 304. The flexible wall 306 may be configured to be displaced to reduce a volume of the reservoir 304. Additionally, in this implementation, the side view illustrated in FIG. 4 shows an inflexible wall 406 opposite the flexible wall 306. Here, flexible wall 306 may comprise a flexible and translucent terpolymer, while shelled wall 302 and the inflexible wall 406 may comprise any suitable material for housing the reservoir 304. For example the shelled wall 302 and the inflexible wall 406 may comprise plastic (e.g., terpolymer, polypropylene (PP), acrylonitrile butadiene styrene (ABS)), metal, glass, or any other suitable material. Additionally, although the shelled wall 302 and the inflexible wall 406 are illustrated in FIG. 4 as forming generally a pouch-shaped unit, (i.e., a generally longitudinally U-shaped front body and a latitudinally oval shaped top body, the latitudinally oval shaped top body tapering to a single edge at the bottom of the longitudinally U-shaped body) other shapes are contemplated. For example, cross sections of the shelled wall 302 and the inflexible wall 406 may be generally disc shaped, rectangular, tubular, conical, or any other appropriate shape for housing the reservoir 304 and exposing the flexible wall 306.

FIG. 5 illustrates the deformable roller 102, comprising the napped roller 106 molded about a roller pin 108, coupled to a housing 502. Here, a collar 504 is illustrated to be disposed on top of the housing 502 and about a portion of a roller collar 506 fixed distal to the housing 502. Similarly, as discussed above, the roller collar 506 may rotatably couple with the deformable roller 102 and may support the roller collar 506 to the reservoir 508. The reservoir 508 may comprise a flexible wall 510 and another flexible wall 512 opposite the flexible wall 510. FIG. 5 also illustrates the flexible wall 510 opposite the flexible wall 512 that may form the reservoir 508. In this implementation the flexible wall 510 and the flexible wall 512 may comprise a substantially clear/translucent terpolymer. However, the flexible wall 510 may be translucent and the flexible wall 512 may be opaque or tinted. Additionally, while both flexible walls 510 and 512 are described here as being formed of terpolymer, the flexible walls 510 and 512 may be formed of any other suitable material that allows the walls 510 and 512 to be displaced as well as be non-reactive or resistant to the product being dispensed. Again, the housing 502 is illustrated in FIG. 5 as being generally a pouch-shaped unit (i.e., a generally longitudinally U-shaped front body and latitudinally oval shaped top body, the latitudinally oval shaped top body tapering to a single edge at the bottom of the longitudinally U-shaped body). However, other shapes are contemplated. For example, the housing 502 may be generally disc shaped, rectangular, tubular, conical, or any other shape appropriate for a reservoir.

Example Process for Using a Dispenser Comprising a Deformable Roller

Figure 6:
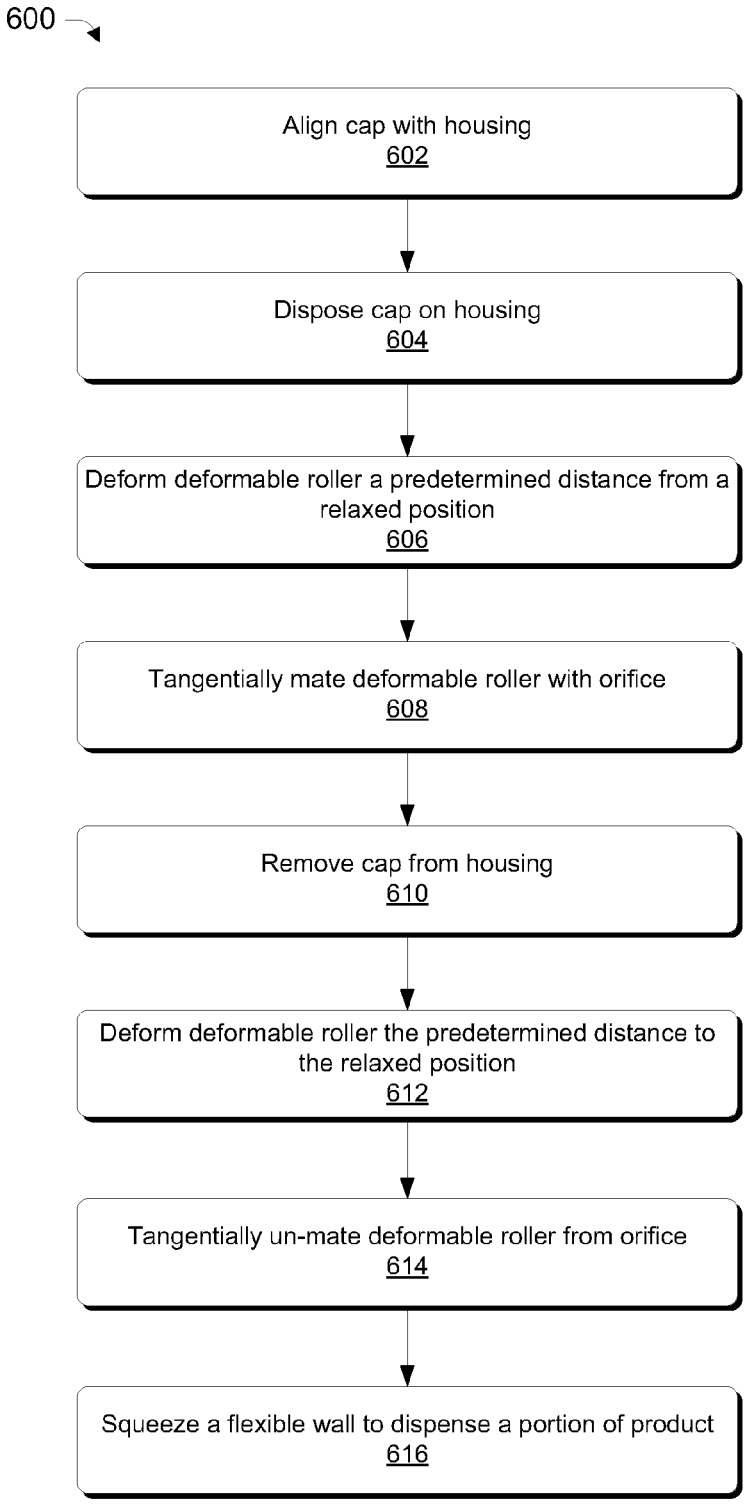
FIG. 6 illustrates an example process 600 of using a dispenser comprising a deformable roller.

FIG. 6 illustrates an example process 600 for using a dispenser (e.g., dispenser 100) comprising a deformable roller (e.g., deformable roller 102) comprising a napped roller (e.g., napped roller 106) molded about a roller pin (e.g., roller pin 108). Process 600 may be based at least in part on the deformable roller deforming and tangentially mating and/or un-mating with the orifice for sealing and/or un-sealing a reservoir (e.g., reservoir 304). In some instances, the process may be performed at a manufacturing facility and during the assembly of the dispenser prior to retail delivery. Alternatively, in some instances, the process may be performed at a packaging facility subsequent to manufacturing and subsequent to filling the reservoir with a product (e.g., ointments, lipstick, lip balm, skin creams, lotions, or the like). While FIG. 6 illustrates a process for using a dispenser comprising a deformable roller configured to deform and tangentially mate and/or un-mate with an orifice for sealing and/or un-sealing a reservoir, this process may apply to the use of any type of deformable roller configured to deform and mate and/or un-mate with any type of mechanism. For example, this process may be directed toward a vibrating deformable roller configured to deform and mate and/or un-mate with an on/off power switch for activating and/or un-activating the vibrating deformable roller.

Process 600 includes an operation 602, which represents aligning a cap (e.g., cap 124) with a housing (e.g., housing 104) comprising a reservoir for containing a product. Next, process 600 proceeds to operation 604, which represents removably disposing the cap on the housing encapsulating a deformable roller. In some instances, the deformable roller may comprise a napped roller formed of rubber, terpolymer, or ABS, over-molded to, and encasing, a roller pin formed of PP, or LDPE. Process 600 continues to operation 606, where subsequent to at least removably disposing the cap onto the housing, a portion (e.g., protrusions 126) of the cap tangentially mates with the deformable roller 102 opposite to an orifice (e.g., orifice 110) deforming (i.e., displacing) the deformable roller a predetermined distance (e.g., separation distance 316). Operation 606 is followed by operation 608 where the displaced deformable roller tangentially mates with the orifice, sealing the reservoir. Here, the reservoir may have been at least partially filled with a product by a manufacture of the dispenser or the reservoir may have been at least partially filled with a product by a packaging company in preparation for delivery to a retail environment (e.g., a brick and mortar retail store or an online retail outlet). Operation 608 may be followed by operation 610 where, a user may remove the cap, and likewise the portion of the cap tangentially mated with the deformable roller. After operation 610, process 600 continues with operation 612, where the deformable roller deforms a distance back to a relaxed position (e.g., relaxed position 324). Operation 612 is followed by operation 614 where the displaced deformable roller un-mates with the orifice, un-sealing the reservoir. Operation 614 may be followed by operation 616 where, a user may choose to squeeze a flexible wall (e.g., flexible wall 306) configured to be displaced to reduce a volume of the reservoir for dispensing a portion of a product. Here, the dispensed portion of product may be dispersed about a face (e.g., face 114) for deposit onto the deformable roller for subsequently applying to a body. In some implementations, a user may choose to squeeze a flexible wall (e.g., flexible wall 306) opposite an inflexible wall (e.g., in-flexible wall 406). Alternatively, in other implementations, a user may choose to squeeze a flexible wall (e.g., flexible wall 510) opposite another flexible wall (e.g., flexible wall 512).

Conclusion

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having a napped roller encasing a roller pin, other types of encasing rollers are also contemplated. For example, a sponge roller, a flocked roller, or a translucent roller may encase the roller pin.

What is claimed is:

1. A dispenser comprising:

a rigid housing containing an inner reservoir for containing a product, the inner reservoir comprising a flexible wall for forcing the product from the dispenser;

a housing collar disposed on top of and coupled to the rigid housing;

a cradle disposed at a distal end of the housing collar and having a product delivery duct extending through the housing collar and communicatively coupled to a coupling mechanism of the inner reservoir;

an orifice disposed in the cradle and interconnected to the inner reservoir via the product delivery duct;

a deformable roller disposed tangent to the orifice, the deformable roller configured for applying product to a body and for deforming and tangentially mating and/or un-mating with the orifice for sealing and/or un-sealing the inner reservoir; and a first member protruding substantially perpendicular from the first end of the cradle and a second member protruding substantially perpendicular from the second end of the cradle, the first member and the second member having first and second sockets, respectively, configured to rotatably couple with first and second ends of the deformable roller, respectively.

2. The dispenser of claim 1, wherein the orifice is parabolic-shaped.

3. The dispenser of claim 1, wherein the deformable roller comprises a napped roller formed of a first material for applying a product to a body, the napped roller encasing a roller pin formed of a second material harder than the first material for axially supporting the napped roller.

4. The dispenser of claim 3, wherein the first material is over-molded on the second material.

5. The dispenser of claim 4, wherein the first material comprises rubber, nitrile-butadiene rubber (NBR), terpolymer or acrylonitrile butadiene styrene (ABS).

6. The dispenser of claim 4, wherein the second material comprises polypropylene (PP) or low-density polyethylene (LDPE).

7. The dispenser of claim 1, wherein the flexible wall comprises terpolymer.

8. The dispenser of claim 1, wherein the inner reservoir comprises another flexible wall opposite the flexible wall.

9. The dispenser of claim 1, wherein the housing comprises an inflexible wall opposite the flexible wall of the inner reservoir.

10. The dispenser of claim 1, wherein the flexible wall is substantially clear.

11. The dispenser of claim 1, further comprising a cap that is substantially the same shape as the housing.

12. The dispenser of claim 1, wherein the cradle terminates proximate to a bottom edge of a roller pin encased by the roller.

13. The dispenser of claim 1, wherein the cradle has a center height greater than a height at the first end of the cradle and a height at the second end of the cradle.

14. A dispenser comprising:

a housing comprising a rigid exterior shell and a flexible inner reservoir for containing a product, at least a portion of the flexible inner reservoir being accessible through the rigid exterior shell;

a housing collar disposed on top of the housing, coupled to the rigid exterior shell;

an elongated convex cradle disposed at a distal end of the housing collar and having a product delivery duct extending through the housing collar to communicatively couple to the flexible inner reservoir;

an orifice disposed in the cradle and interconnected to the flexible inner reservoir via the product delivery duct;

a roller disposed tangent to the orifice;

a first member protruding substantially perpendicular from a first end of the elongated convex cradle and a second member protruding substantially perpendicular from a second end of the elongated convex cradle, the first member and the second member having first and second sockets, respectively, configured to rotatably couple with first and second ends of the roller, respectively.

15. A cosmetic dispenser comprising:

a housing comprising a rigid shell disposed around a flexible reservoir and forming an exterior of the housing, a portion of the flexible reservoir being accessible through an opening of the rigid shell to form a flexible wall of the housing;

a housing collar disposed on top of the housing, coupled to the rigid shell;

a roller collar mounted on the housing collar, the roller collar comprising:

a convex cradle with a single dispensing orifice;

a connector stem extending from the dispensing orifice, through the housing collar, and mating with a coupling mechanism of the flexible reservoir, thereby communicatively coupling the dispensing orifice to an interior of the flexible reservoir; and a first member protruding substantially perpendicular from a first end of the elongated convex cradle and a second member protruding substantially perpendicular from a second end of the elongated convex cradle, the first member and the second member having first and second sockets, respectively.

16. The cosmetic dispenser of claim 15, further comprising a roller disposed in the cradle coupled to the first and second sockets.

17. The cosmetic dispenser of claim 15, wherein the coupling mechanism of the flexible reservoir extends from the flexible reservoir to receive and secure the connector stem.

* * * * *